US007631442B2

(12) United States Patent
Kost et al.

(10) Patent No.: US 7,631,442 B2
(45) Date of Patent: Dec. 15, 2009

(54) MODULAR HYDRAULIC POWER MECHANISM

(75) Inventors: James A. Kost, Cleveland, OH (US); Robert L. Potak, Strongsville, OH (US)

(73) Assignee: Louis Berkman Winter Products Company, Cleveland, OH (US)

( * ) Notice: Subject to any disclaimer, the term of this patent is extended or adjusted under 35 U.S.C. 154(b) by 548 days.

(21) Appl. No.: 11/365,705

(22) Filed: Mar. 1, 2006

(65) Prior Publication Data

US 2007/0051021 A1 Mar. 8, 2007

Related U.S. Application Data

(60) Provisional application No. 60/657,565, filed on Mar. 1, 2005.

(51) Int. Cl.
*E01H 5/04* (2006.01)

(52) U.S. Cl. ..... 37/234; 37/236; 137/271; 137/884

(58) Field of Classification Search ..... 37/234, 37/235, 236, 231, 903; 60/420–422; 91/508–536; 137/269, 271, 884, 270
See application file for complete search history.

(56) References Cited

U.S. PATENT DOCUMENTS 3,201,878 A * 8/1965 Markwardt ..... 37/231
3,307,275 A * 3/1967 Simi ..... 37/234
3,432,946 A * 3/1969 Peitl ..... 37/234
3,773,074 A 11/1973 Miceli
3,934,605 A 1/1976 Legris
4,026,048 A * 5/1977 Hill et al. ..... 37/234
4,028,820 A * 6/1977 Simonds, Jr. ..... 37/234
4,167,200 A * 9/1979 Bouteille ..... 137/884
4,244,122 A * 1/1981 Hetrick ..... 37/234
4,359,064 A 11/1982 Kimble
4,640,311 A 2/1987 Martinet et al.
4,898,333 A * 2/1990 Kime et al. ..... 239/657
4,964,273 A * 10/1990 Nash ..... 60/325
4,999,935 A * 3/1991 Simi et al. ..... 37/236
5,485,690 A 1/1996 MacQueen
5,568,694 A * 10/1996 Capra et al. ..... 37/231
5,603,172 A * 2/1997 Maher ..... 37/233
5,666,747 A 9/1997 MacQueen
5,829,174 A * 11/1998 Hadler et al. ..... 37/234
5,832,637 A * 11/1998 Aguado et al. ..... 37/234
5,987,785 A 11/1999 Aguado et al.
6,044,579 A * 4/2000 Hadler et al. ..... 37/234

(Continued)

*Primary Examiner*—Thomas A Beach
(74) *Attorney, Agent, or Firm*—Emerson, Thomson & Bennett; Roger Emerson; Timothy Bennett

(57) ABSTRACT

A modular hydraulic power mechanism provides hydraulic power to a snowplow system for use in moving a snowplow. The hydraulic power mechanism includes a base unit including a base plate, a hydraulic reservoir and a hydraulic pump unit. To the base unit may be added a first hydraulic module that can be mounted to the base plate and that is designed to meet a specific hydraulic need, such as up and down motion, for the snowplow of a first snowplow system. To the same base unit a second hydraulic module may be mounted that is designed to meet a different hydraulic need, such as side to side motion, for the first snowplow system. Alternately, to the same base unit one or more hydraulic modules can be mounted to the base plate in order to provide all the hydraulic needs of a second snowplow system, such as a V-plow.

9 Claims, 17 Drawing Sheets

U.S. PATENT DOCUMENTS 6,108,946 A * 8/2000 Christy ..... 37/272
6,134,814 A * 10/2000 Christy et al. ..... 37/236
6,154,986 A * 12/2000 Hadler et al. ..... 37/234
6,163,985 A * 12/2000 Chinnery et al. ..... 37/234
6,170,178 B1 * 1/2001 Christy ..... 37/231
6,173,513 B1 * 1/2001 Akimoto ..... 37/414
6,178,669 B1 * 1/2001 Quenzi et al. ..... 37/231
6,260,583 B1 7/2001 Flatt et al.
6,276,076 B1 * 8/2001 Quenzi et al. ..... 37/231
6,393,737 B2 * 5/2002 Quenzi et al. ..... 37/231
6,408,549 B1 6/2002 Quenzi et al.
6,615,513 B2 * 9/2003 Quenzi et al. ..... 37/231
6,688,325 B2 2/2004 Hettinger
6,688,328 B2 * 2/2004 Van Wie ..... 137/376
6,691,435 B1 * 2/2004 Schultz et al. ..... 37/234
6,782,915 B2 * 8/2004 Van Wie ..... 137/354
7,069,675 B2 * 7/2006 Nishi et al. ..... 37/348
7,114,270 B2 * 10/2006 Potak ..... 37/231
2001/0047600 A1 * 12/2001 Quenzi et al. ..... 37/270
2002/0088149 A1 * 7/2002 Quenzi et al. ..... 37/231
2003/0010196 A1 * 1/2003 Smith et al. ..... 91/536
2004/0187359 A1 * 9/2004 Nishi et al. ..... 37/348
2007/0092366 A1 * 4/2007 Bose ..... 414/607

* cited by examiner

MODULAR HYDRAULIC POWER MECHANISM

This application claims priority from provisional application U.S. Ser. No. 60/657,565 titled MODULAR HYDRAULIC POWER MECHANISM, filed Mar. 1, 2005, which is incorporated herein by reference.

I. BACKGROUND OF THE INVENTION

A. Field of Invention

This invention pertains to the art of methods and apparatuses for snowplows and more specifically to a modular hydraulic power mechanism that is used to provide hydraulic power to a snowplow system.

B. Description of the Related Art

It is well known in the art to provide snowplow systems for use in moving snow from roads, driveways, parking lots and other such surfaces. Typically, the snowplow system is attached to a vehicle such as a pickup truck. Usually, the snowplow can be moved by the driver/operator of the vehicle. Thus, for example, the operator can adjust a control system from inside the occupant compartment of the vehicle to raise and lower the snowplow and pivot the snowplow.

In recent years, the snowplow industry has provided additional snowplow designs and movement options. A relatively new snowplow, for example, is termed a V-plow and is essentially two plows combined onto a single frame. In this case, each plow is generally considered a wing and typically each wing can be controlled independent of the opposite wing. Another known type of plow consists of a middle portion which cannot be pivoted and a pair of pivotable wings on each end. Most often snowplows are moved using a hydraulic system. As a result, hydraulic components such as hydraulic cylinders, hydraulic piping and hoses, appropriate fittings and the like are required to operate the snowplow. A hydraulic power mechanism is also generally provided to receive some type of control signal from the operator and convert that signal into the appropriate movement of the hydraulic components so that the snowplow is positioned properly. Such hydraulic power mechanisms are known to include a base plate, a hydraulic reservoir or tank, a hydraulic pump unit, and the necessary control valves such as solenoid valves and/or cartridge valves. Such known hydraulic power mechanisms work well for their intended purpose.

One known difficulty, however, with known hydraulic power mechanisms is that a separate power mechanism is required for each snowplow system arrangement. Thus, for example, one hydraulic power mechanism is appropriate for a standard plow while a second hydraulic power mechanism is required for a V-plow. A third hydraulic power mechanism is required for the plow having a middle portion which cannot be pivoted and a pair of pivotable wings on each end. Other snowplow designs require yet additional separate hydraulic power mechanisms. This requirement for a large number of hydraulic power mechanisms forces snowplow system distributors to maintain a large inventory. This increases the need for inventory space and adds to the expense of the snowplow systems.

This difficulty is partially addressed in U.S. Pat. No. 3,773,074, titled HYDRAULIC CONTROL UNIT (the '074 patent), which has a common assignee to this patent application and which is incorporated herein by reference. The '074 patent provides a power unit having a base portion with a sidewall. To the sidewall different control blocks may be attached to provide corresponding different snowplow functions. While the power unit of the '074 patent works well for its intended purpose, it has limitations. One limitation is that the power unit is defined by a reservoir ram unit in which a lift cylinder is positioned. The area around the lift cylinder defines the hydraulic fluid reservoir. This incorporation of the lift cylinder with the power unit limits the range of modular adjustment available and positions the reservoir above the base portion. Another limitation of the power unit of the '074 patent is that the different control blocks must be attached to the side of the base portion. This "sideways" design makes modular adjustment more difficult.

The present invention minimizes these difficulties by providing a modular hydraulic power mechanism that can be simply modified to accommodate a wide range of snowplow systems and where the hydraulic components do not define any portion of the hydraulic power mechanism.

II. SUMMARY OF THE INVENTION

According to one embodiment of this invention, a modular hydraulic power mechanism is provided for use with a snowplow. The hydraulic power mechanism includes a base unit including a base plate positioned substantially horizontally, a hydraulic reservoir connected to the base plate and positioned below the base plate and, a hydraulic pump unit connected to the base plate and positioned substantially above the base plate. One or more hydraulic modules are then mounted to the top of the base plate in order to provide the required hydraulic functions. Thus, the same base unit can accommodate various hydraulic modules to accommodate the particular snowplow or hydraulic components.

One advantage of this invention is that hydraulic system inventories can be reduced.

Another advantage of this invention is that the hydraulic power mechanism can be easily modified to accommodate different hydraulic power functions.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION OF THE INVENTION

Figure 1:
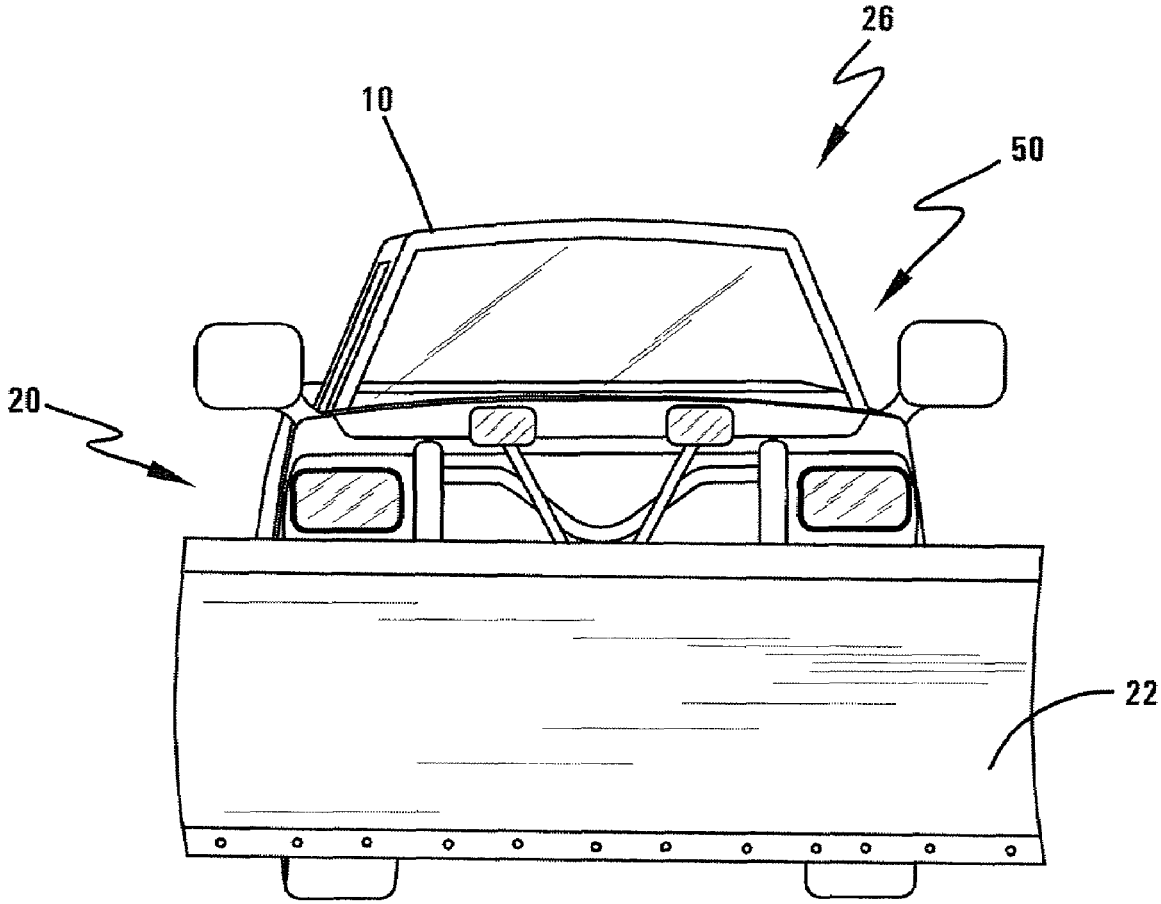
FIG. 1 is a perspective front view of a vehicle equipped with a straight snowplow and including the hydraulic power mechanism of this invention.
Figure 2:
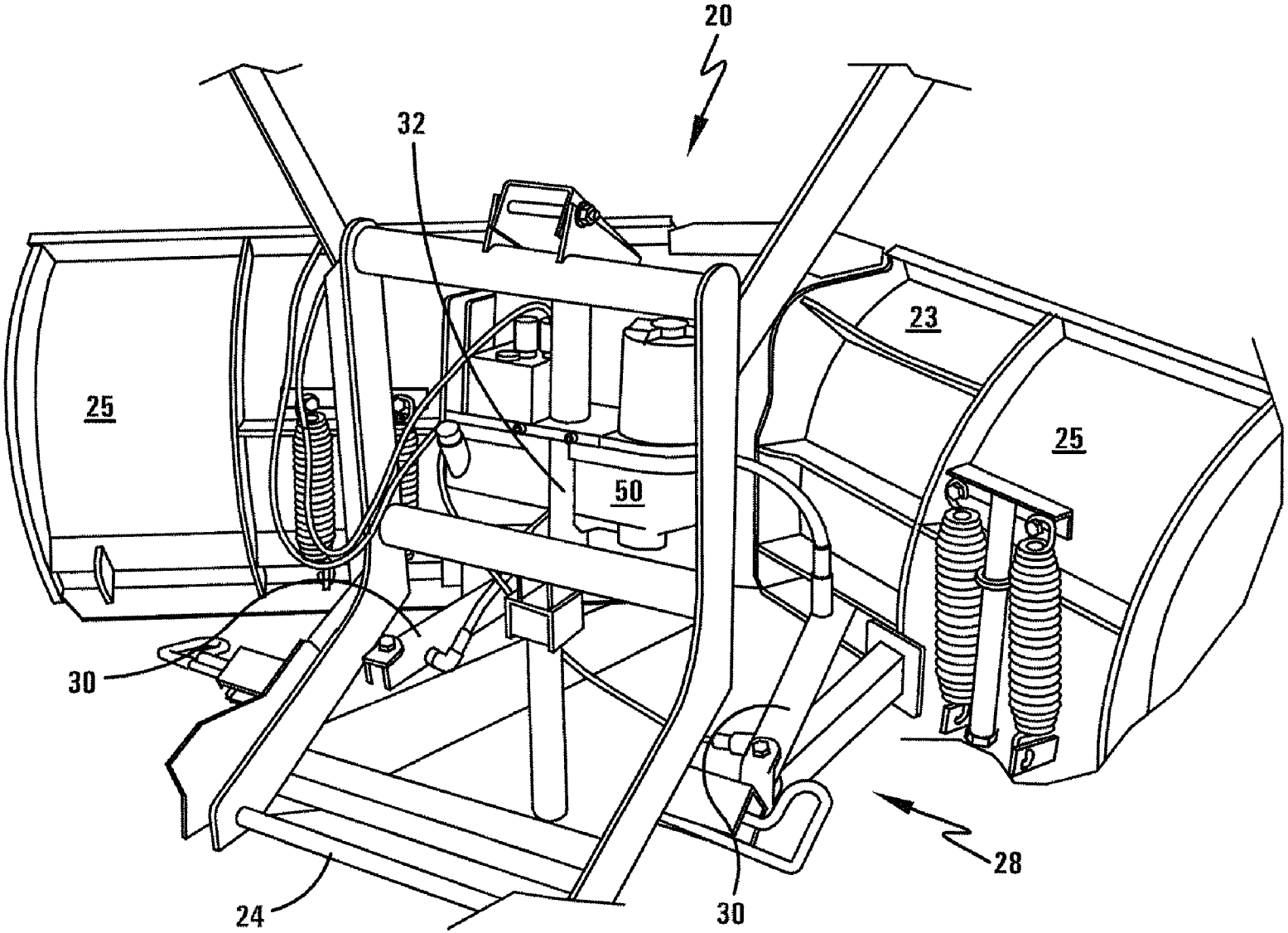
FIG. 2 is a perspective back view showing the hydraulic power mechanism of this invention according to one embodiment mounted to a V-plow snowplow system.
Figure 3:
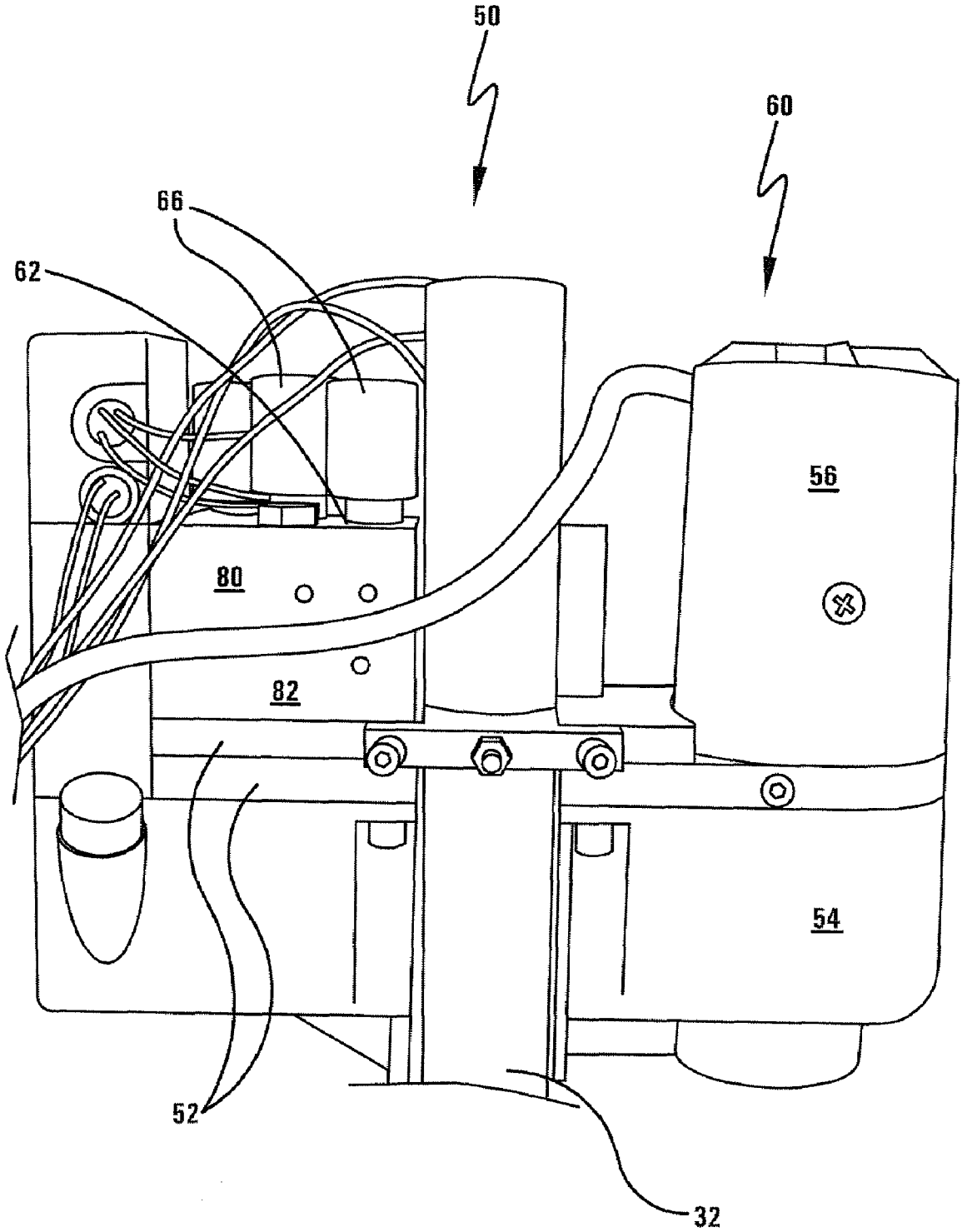
FIG. 3 is a back close-up view of the hydraulic power mechanism shown in FIG. 2.
Figure 4:
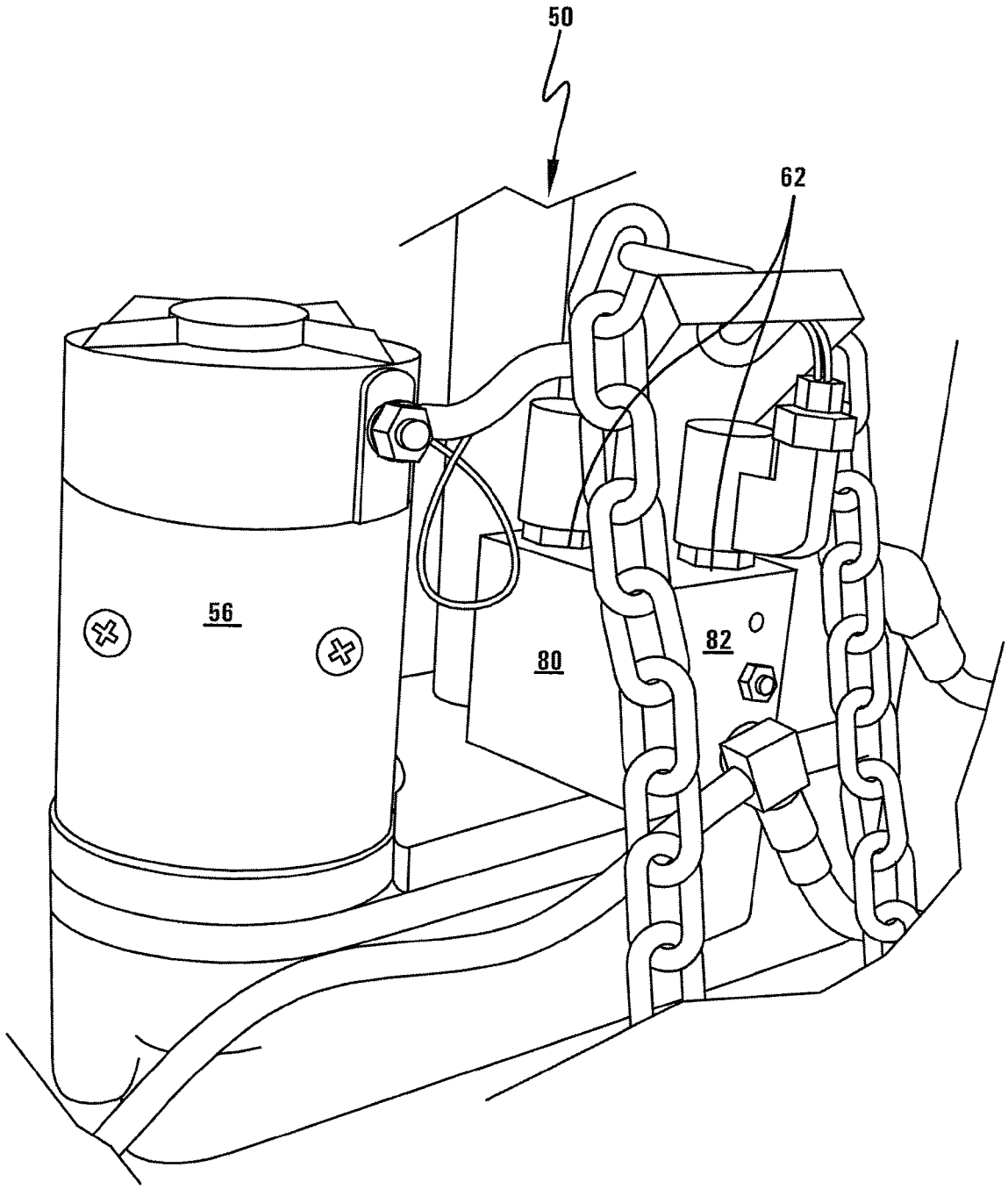
FIG. 4 is a perspective back/left side view of the hydraulic power mechanism shown in FIG. 3.
Figure 5:
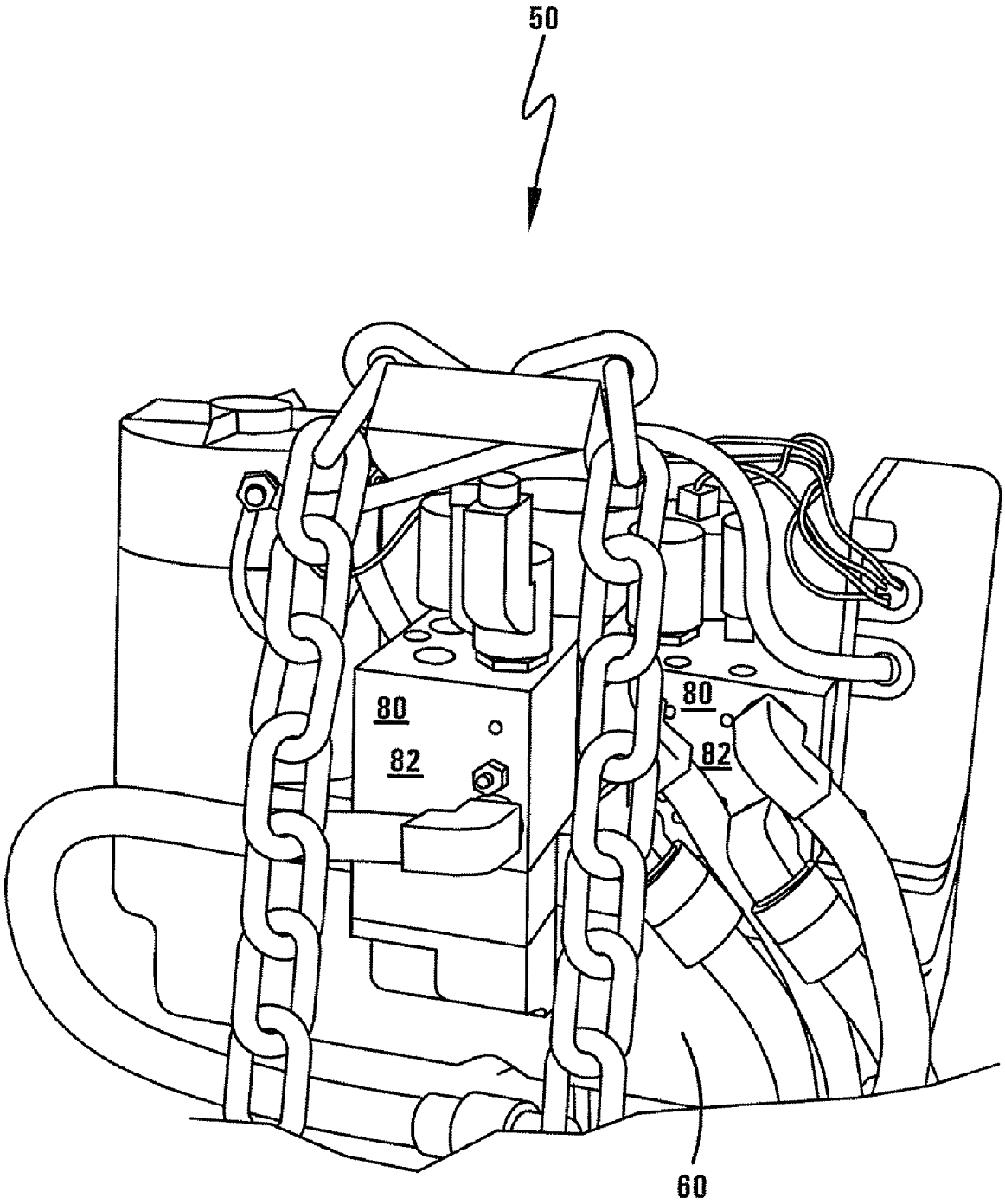
FIG. 5 is a perspective back/right side view of the hydraulic power mechanism shown in FIG. 3.
Figure 6:
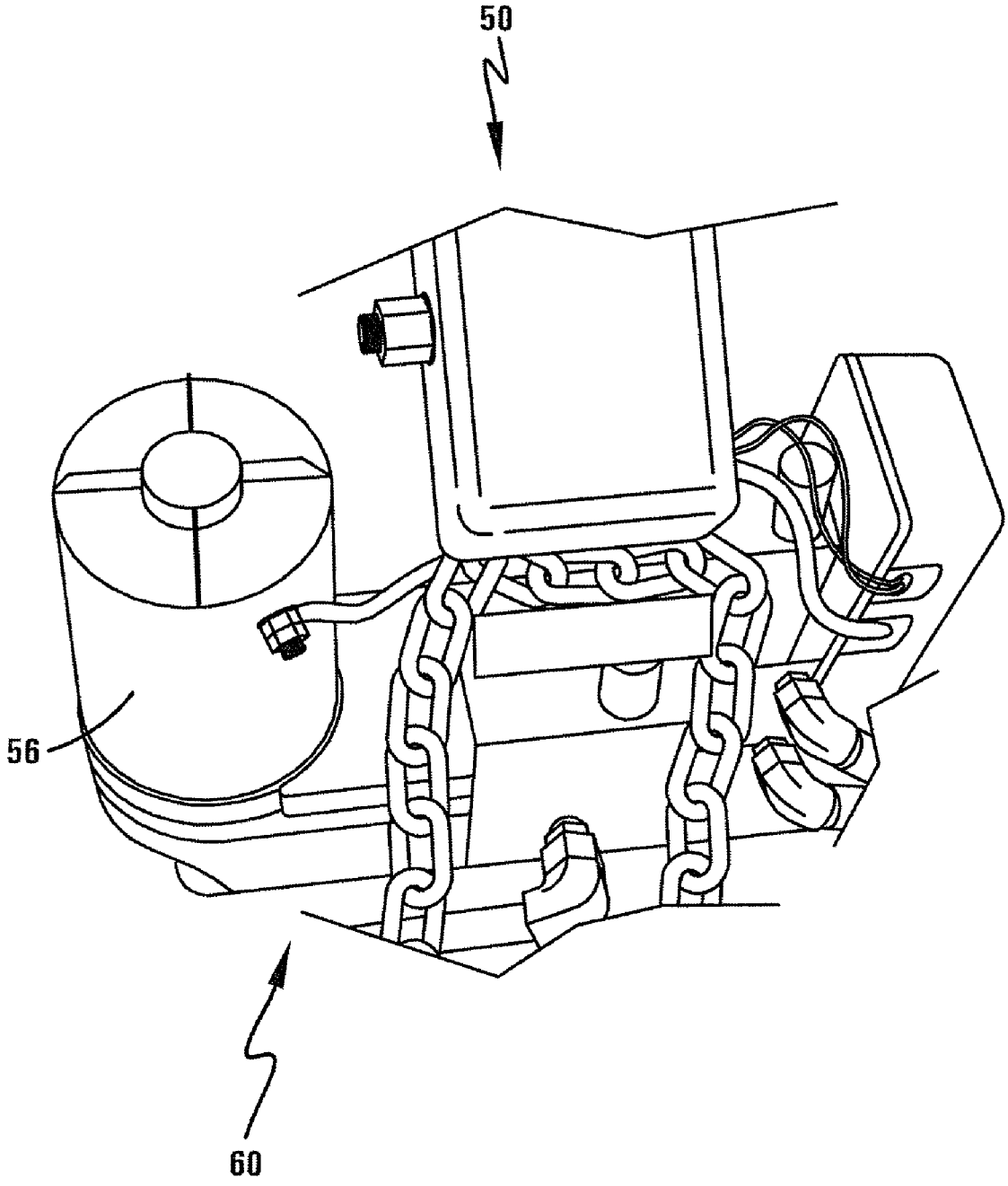
FIG. 6 is a perspective back/top view of the hydraulic power mechanism shown in FIG. 3.
Figure 7:
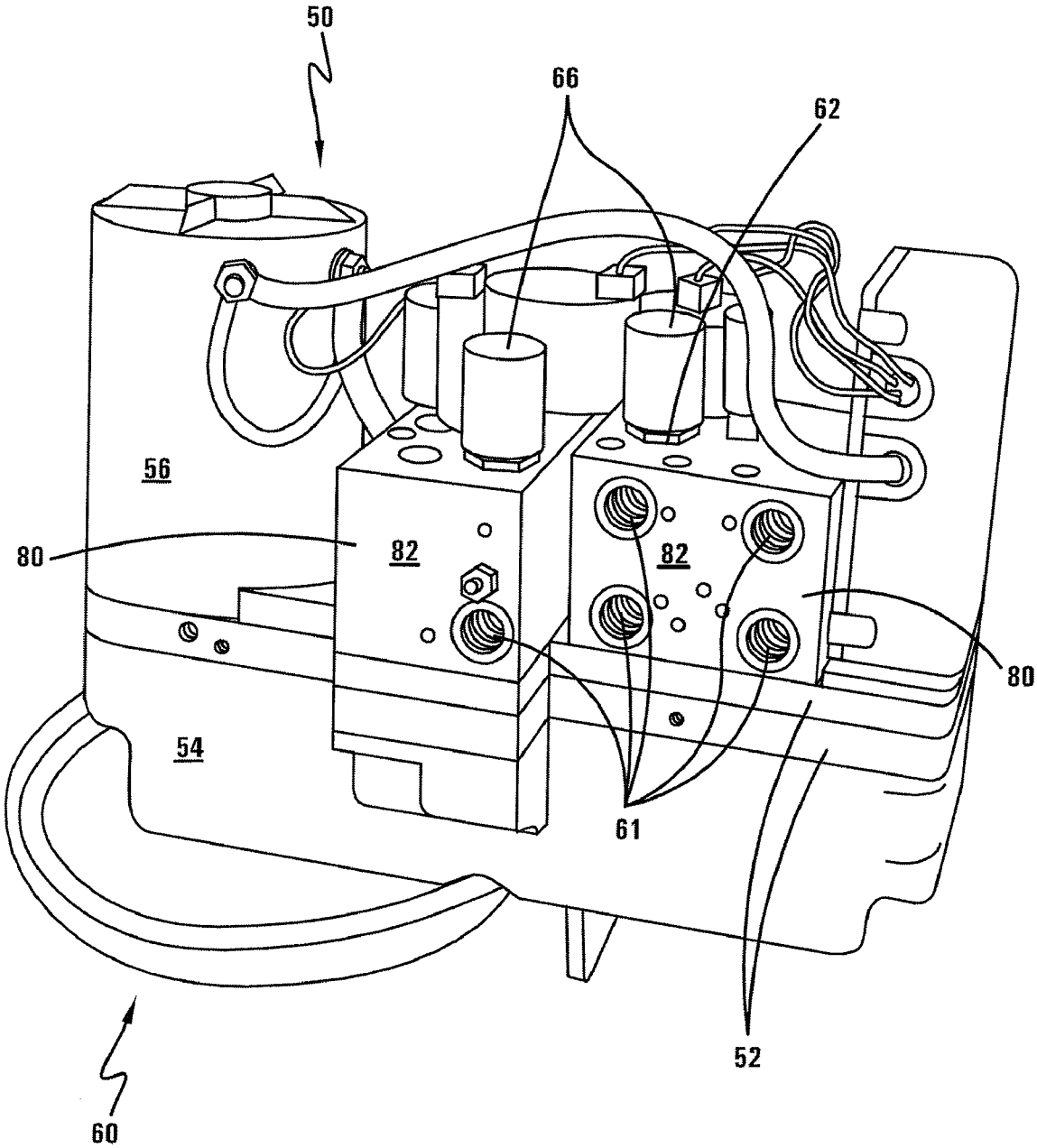
FIG. 7 is a perspective back view of the hydraulic power mechanism shown unattached to a snowplow system.
Figure 8:
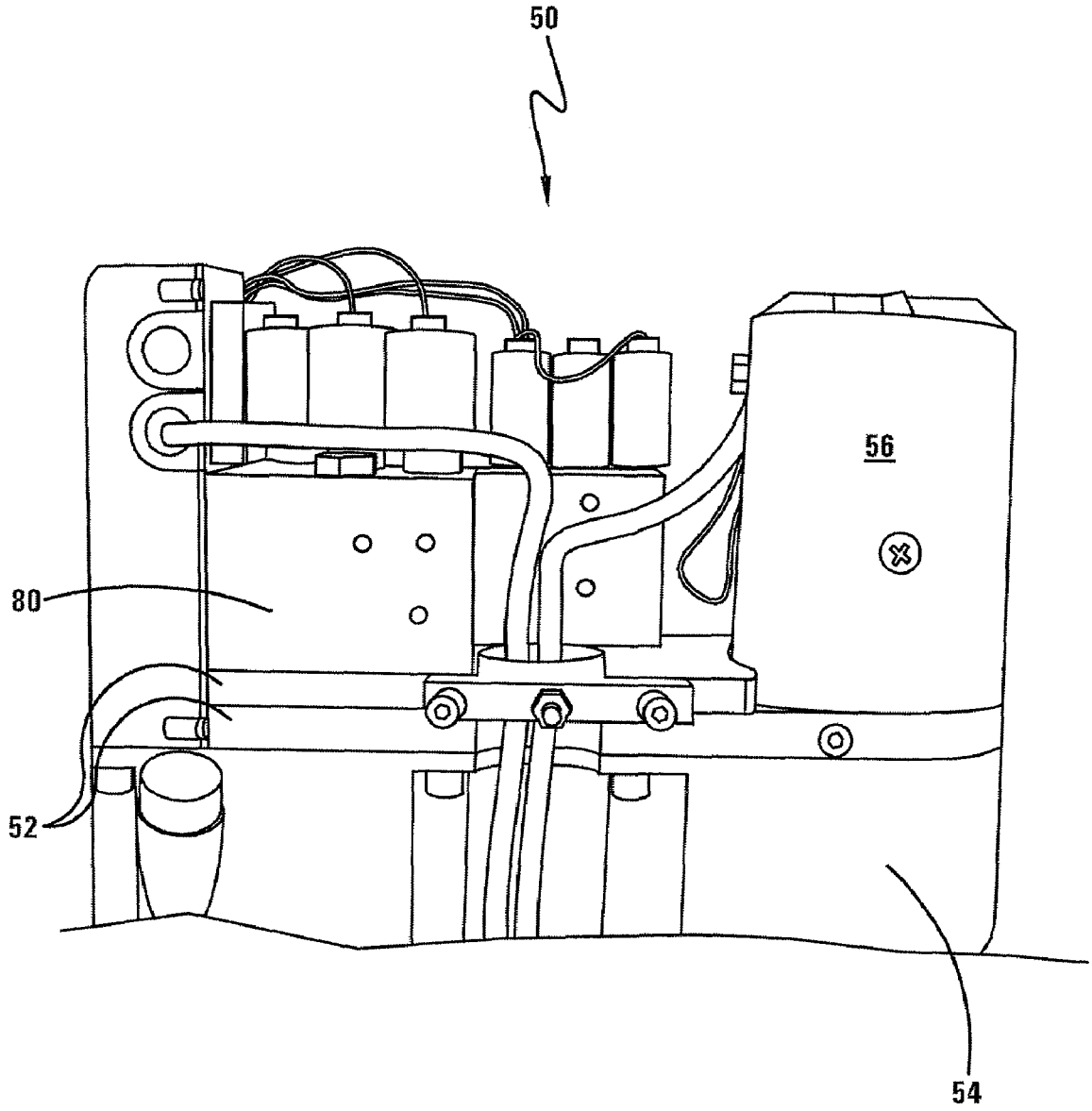
FIG. 8 is a perspective front view of the hydraulic power mechanism shown in FIG. 7.
Figure 9:
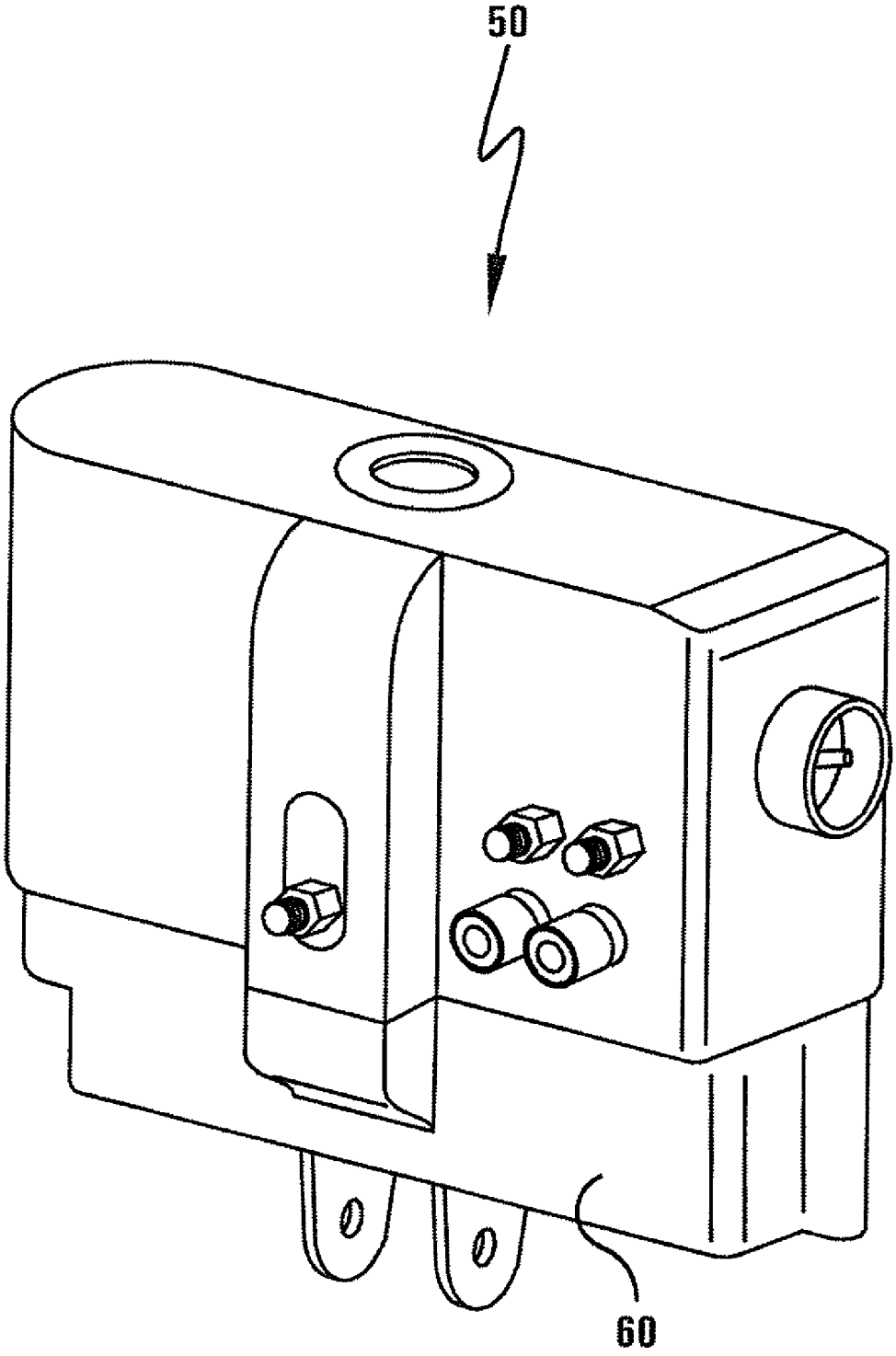
FIG. 9 is a perspective front view of another embodiment of the hydraulic power mechanism enclosed within a housing.
Figure 10:
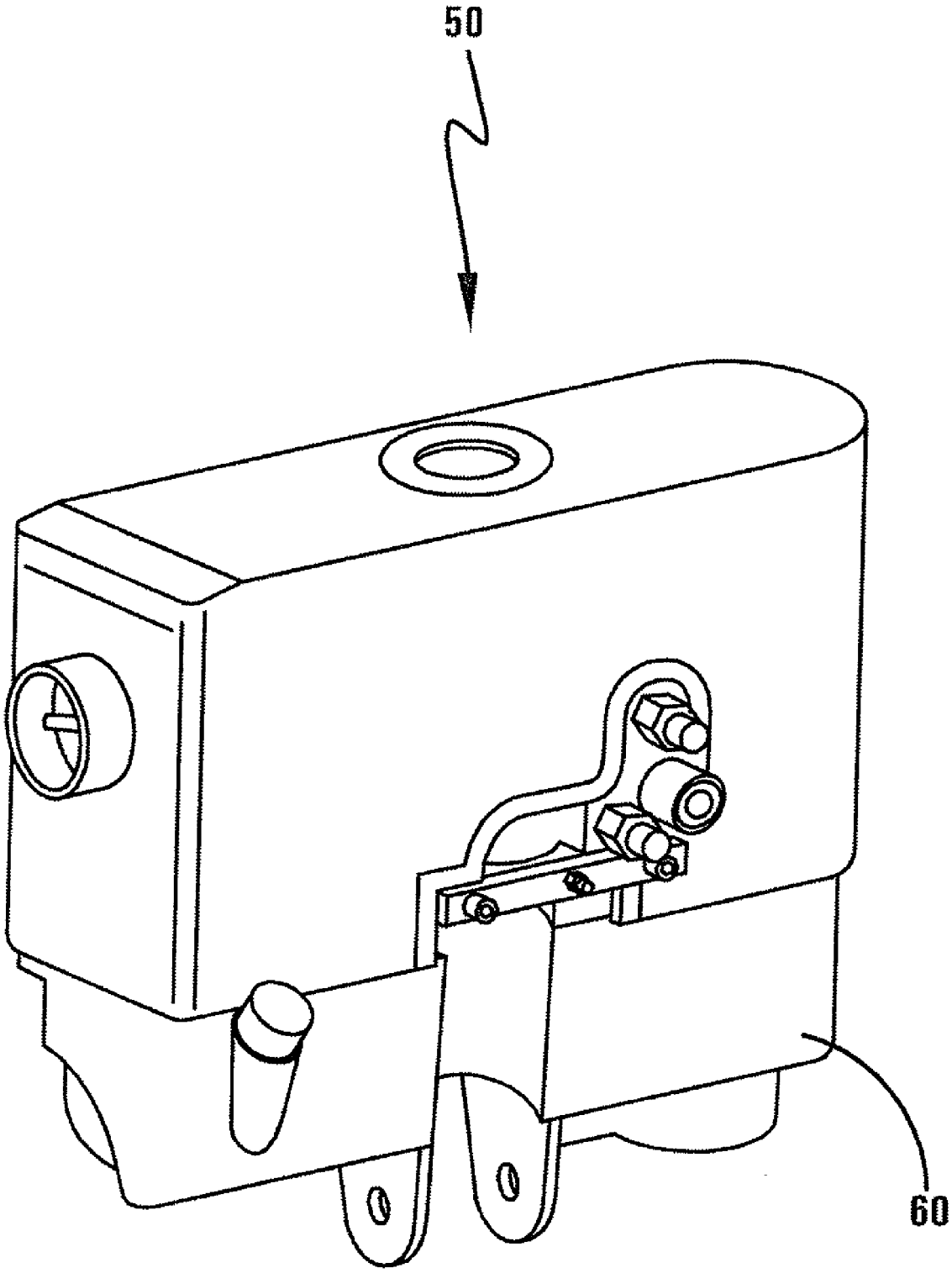
FIG. 10 is a perspective back view of the hydraulic power mechanism shown in FIG. 9.
Figure 11:
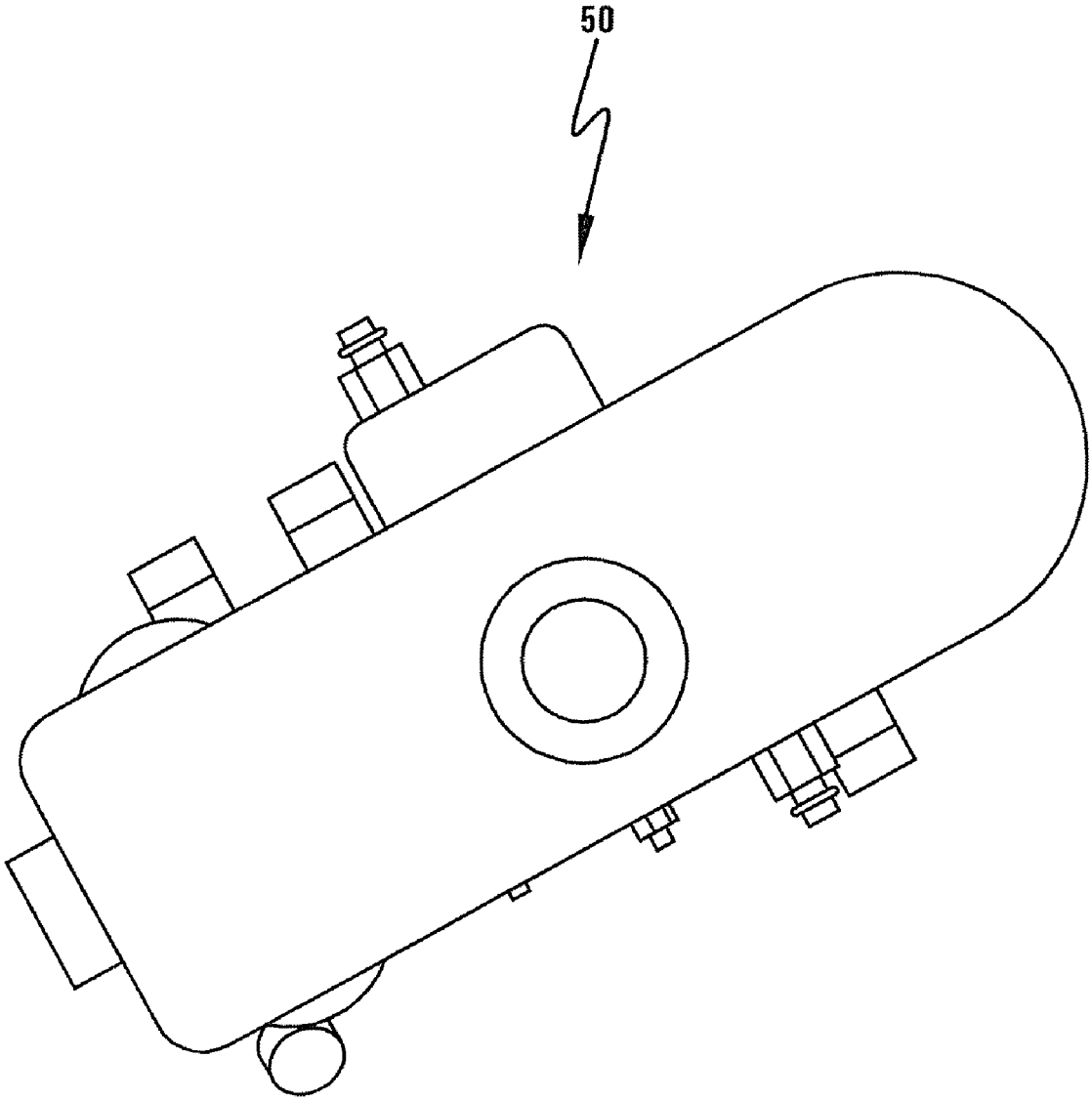
FIG. 11 is a top view of the hydraulic power mechanism shown in FIG. 9.

Referring now to the drawings wherein the showings are for purposes of illustrating embodiments of the invention only and not for purposes of limiting the same, FIG. 1 shows a vehicle 10 equipped with a snowplow system 20 having a straight snowplow 22 and a modular hydraulic power mechanism 50 according to this invention. FIG. 2 shows a snowplow system 20, unattached from a vehicle, having a V-plow 23. The snowplow system 20 for both the straight snowplow 22 and the V-plow 23 (shown mounted to a vehicle in FIG. 13) also includes a snowplow mounting frame 24, a control system 26 (shown in FIG. 12) and a set of hydraulic components 28 used to move the snowplow 22, 23. The particular set of hydraulic components 28 used with this invention and their purposes with a snowplow may be conventional and thus will not be described in great detail here. Note, however, that in the embodiment shown in FIG. 2 the set of hydraulic components 28, includes a pair of rams or hydraulic cylinders 30, 30 used to pivot the snowplow 23 from side to side and a lift cylinder 32 used to raise and lower the snowplow 22. It should also be noted that this invention will also work well with non-conventional hydraulic purposes such as, for example, the use of hydraulic components to attach a snowplow to a vehicle. An example of this purpose is provided in currently pending U.S. patent application Ser. No. 10/790,431 with Publication No. U.S. 2005/0000120, titled PLOW MOUNTING METHOD AND APPARATUS, which has a common assignee to this patent application and which is incorporated herein by reference. The set of hydraulic components 28 also includes all the required corresponding hydraulic piping, hoses and fittings, as shown but not referenced.

With reference to FIGS. 2-3 and 7-8, the hydraulic power mechanism 50 of this invention provides hydraulic power to the snowplow system 20 as will now be described. The hydraulic power mechanism 50 includes a base plate 52 (that may be formed of one, two or more plate members, two shown), a hydraulic reservoir or tank 54, and a hydraulic pump unit 56 used to pump hydraulic fluid from the tank 54 to the set of hydraulic components 28. The base plate 52 is positioned substantially horizontally and has a top and bottom, as shown. The hydraulic reservoir 54 is connected to the bottom of the base plate 54, as shown. The hydraulic pump unit 56 is connected to the base plate 52 and positioned substantially above the base plate 52, as shown. This arrangement of the base plate 52, reservoir 54, and hydraulic pump unit 56 together form a base unit 60. The base plate 52 may have grooves and/or ports (not referenced) to communicate hydraulic fluid, some of which may communicate with the tank 54. One or more gaskets may be positioned above, below and between the base plate 52 members to seal these grooves and/or ports. The particular materials used to form the base unit 60 components can be any type chosen with sound engineering judgment. The hydraulic reservoir or tank 54, for example, may be formed in a metal casting process or an elastomeric molding process. The base plate 52, for example, may be a machined metal component.

With reference now to FIGS. 3-11 and 14-17, the hydraulic power mechanism 50 also includes one or more hydraulic modules 80 that can be mounted to the base plate 52. Each hydraulic module 80 includes a manifold 82 having one or more ports 62 and one or more valves 66 that may be mounted into the ports 62. Each hydraulic module 80 also includes a plurality of openings 61 (shown in FIG. 7) where corresponding hydraulic hoses can be attached to provide hydraulic fluid (and return) to the set of hydraulic components 28. The modularity of this invention permits different combinations of hydraulic valves 66 to be mounted to the same hydraulic module 80. The modularity of this invention also permits different combinations of hydraulic modules 80 to be mounted to the same base plate 52. The tank 54 and hydraulic pump unit 56 are sized to accommodate the maximum number of valves 66 and hydraulic modules 80 that can be attached to the base plate 52.

Figure 13:
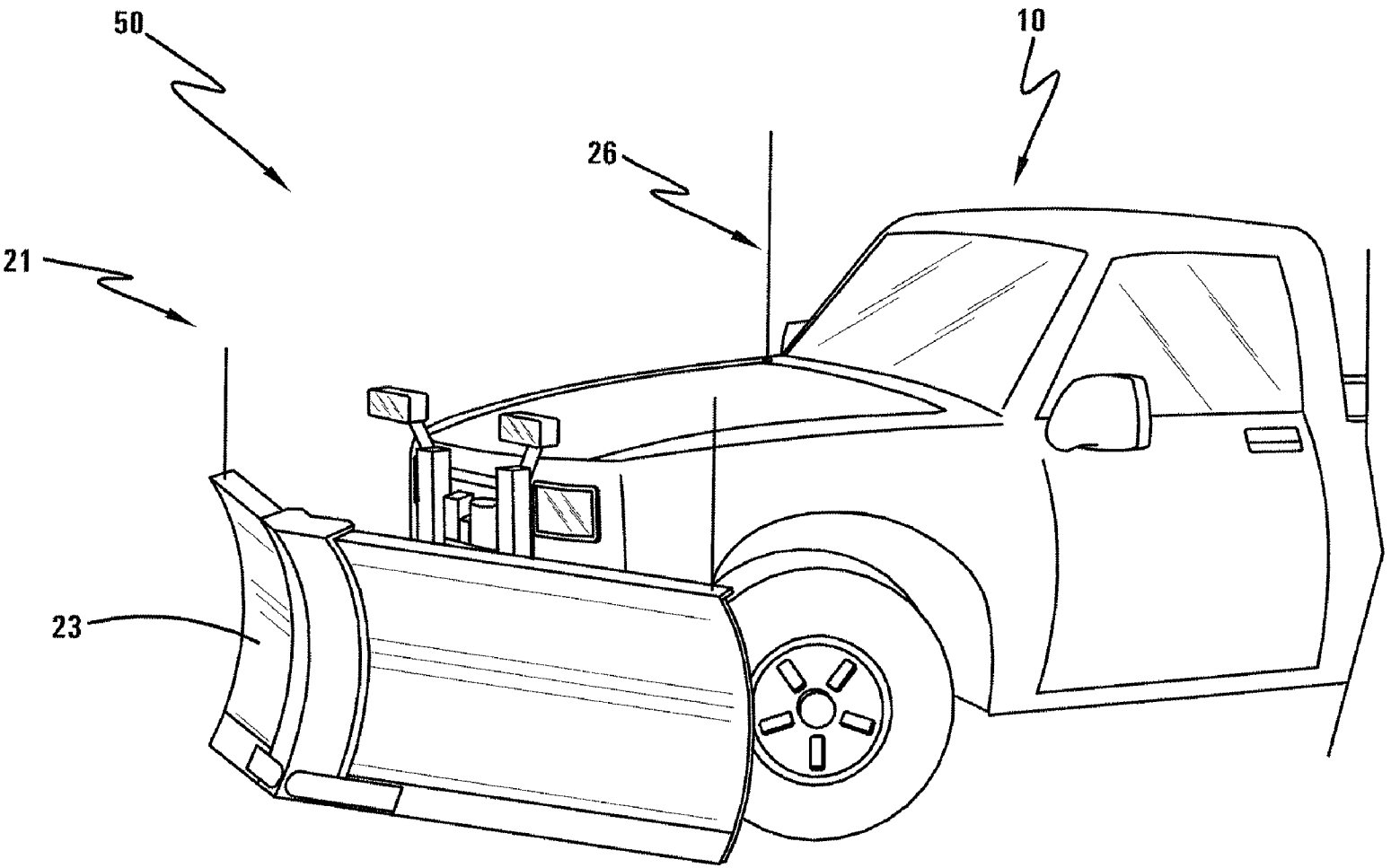
FIG. 13 is a perspective front view of a vehicle equipped with a V-plow and including the hydraulic power mechanism of this invention.
Figure 14:
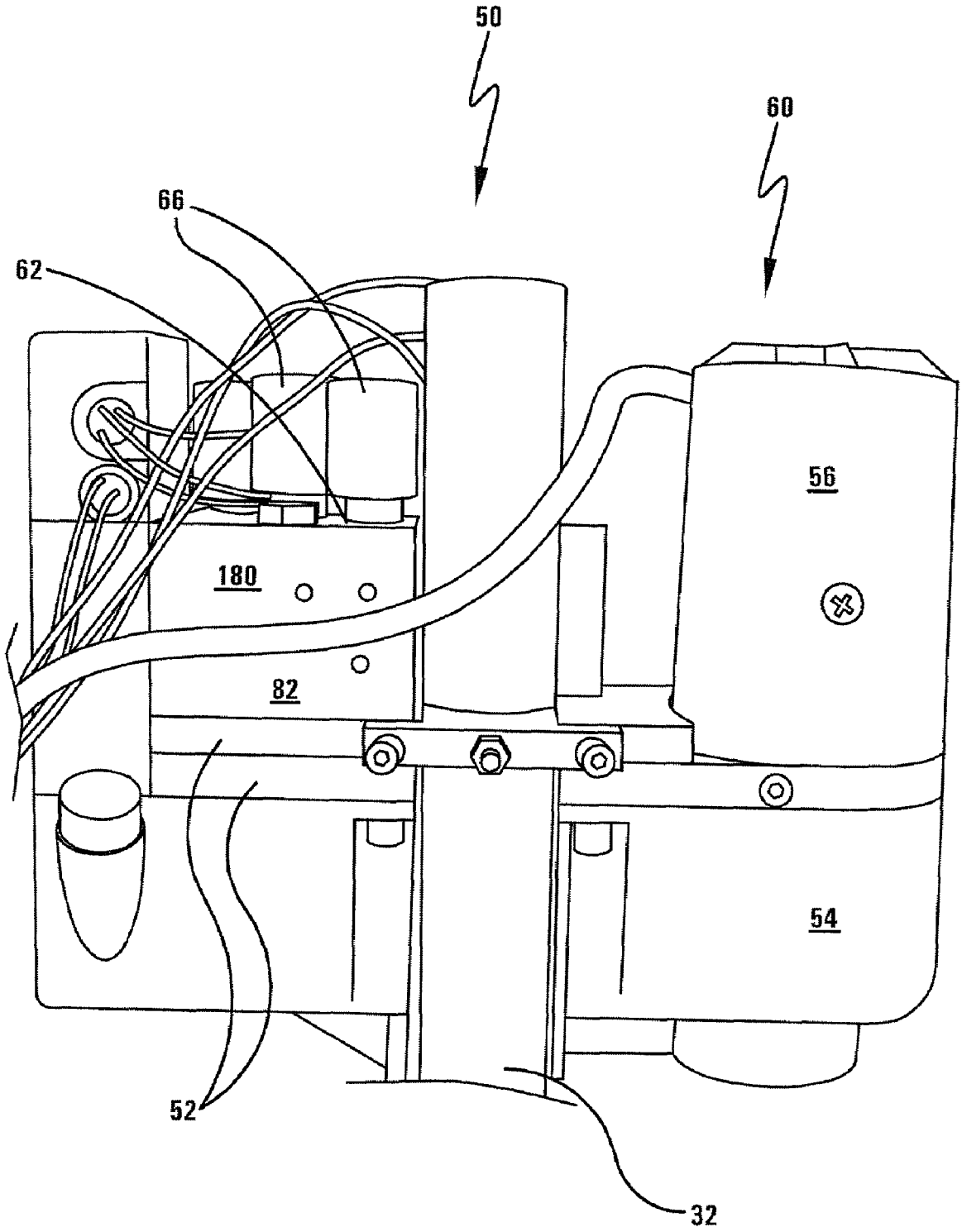
FIG. 14 is a back close-up view of the hydraulic power mechanism shown in FIG. 2, with a second module in place of the first module.
Figure 15:
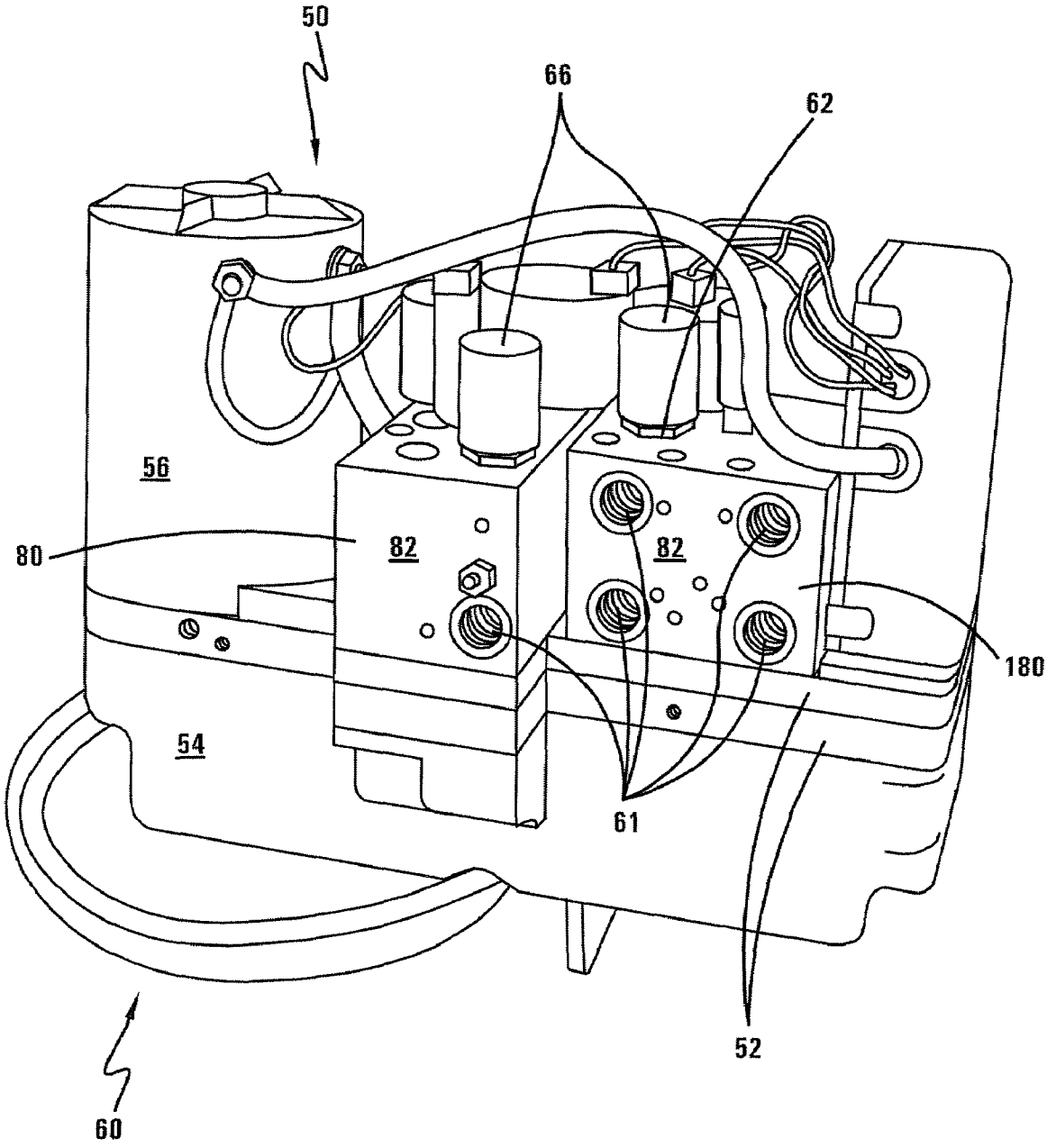
FIG. 15 is a perspective back view of the hydraulic power mechanism shown unattached to a snowplow system, with the first module and the second module.
Figure 16:
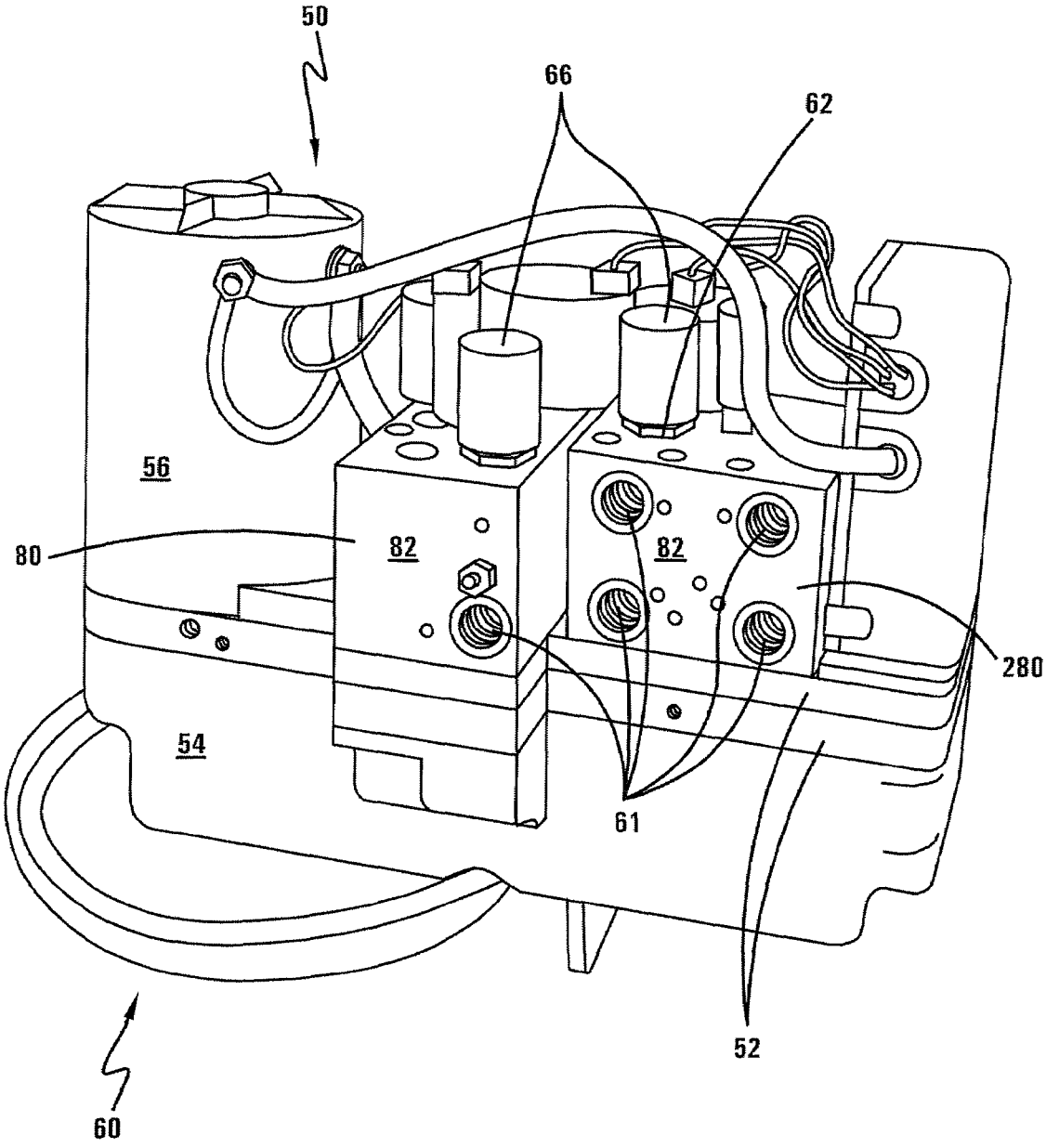
FIG. 16 is a perspective back view of the hydraulic power mechanism shown unattached to a snowplow system, with the first module and a third module.
Figure 17:
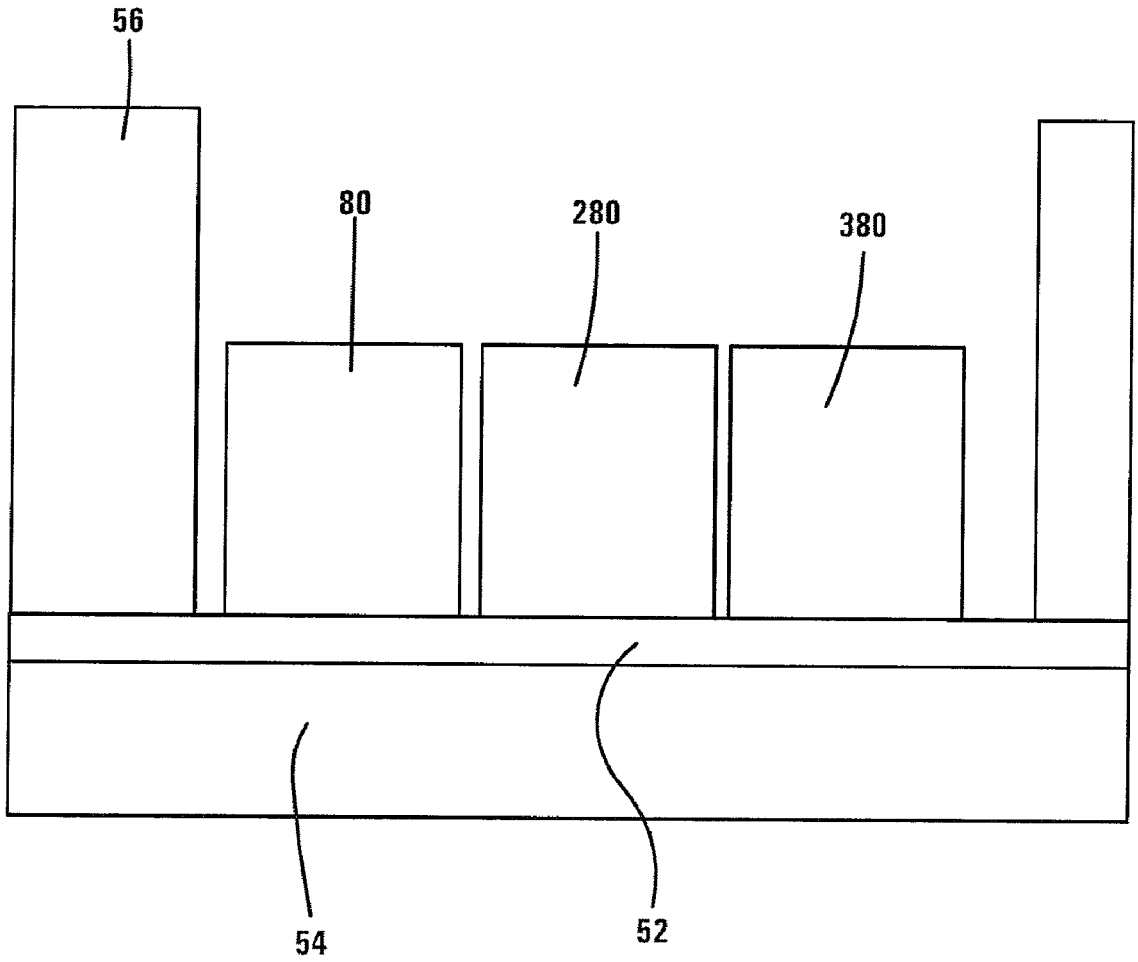
FIG. 17 is a perspective front view of the hydraulic power mechanism shown with the first module, the third module, and a fourth module.

With continuing reference to FIGS. 3-11 and 14-17, in one example the snowplow 22 is intended to be moved up and down. To meet this first particular hydraulic function (moving the snowplow 22 up and down), a first particular hydraulic module 80 that will provide the first particular-hydraulic function is mounted to the base unit 60. As another example, perhaps the snowplow 22 is also intended to be pivoted from side to side. To meet this second particular hydraulic function (pivoting the snowplow 22 from side to side), a second particular hydraulic module 180 that will provide the second particular hydraulic function is mounted to the base unit 60. As another example, perhaps the snowplow 22 is a V-plow design (as shown in FIGS. 2 and 13) requiring a third particular hydraulic function (permitting the wings 25 to pivot independently). In this case, a third particular hydraulic module 280 that will provide the third particular hydraulic function is mounted to the base unit 60. Perhaps the third particular hydraulic module 280 is used in place of the second particular hydraulic module 180. As yet another example, perhaps the snowplow system 20 includes a hydraulic mechanism used to attach the snowplow system 20 to the vehicle 10 (such as that provided in the previously mentioned U.S. patent application Ser. No. 10/790,431 with Publication No. US 2005/0000120, titled PLOW MOUNTING METHOD AND APPARATUS). To meet this fourth particular hydraulic function (attaching the snowplow system 20 to the vehicle 10), a fourth particular hydraulic module 380 that will provide the fourth particular hydraulic function is mounted to the base unit 60. Once the correct hydraulic modules 80 are mounted to the base plate 52, the base unit 60 is mounted to the snowplow system 20 and the corresponding hydraulic piping is installed between the ports 62 in the manifold 82 and the set of hydraulic components 28 used to move or attach the snowplow 22.

Figure 12:
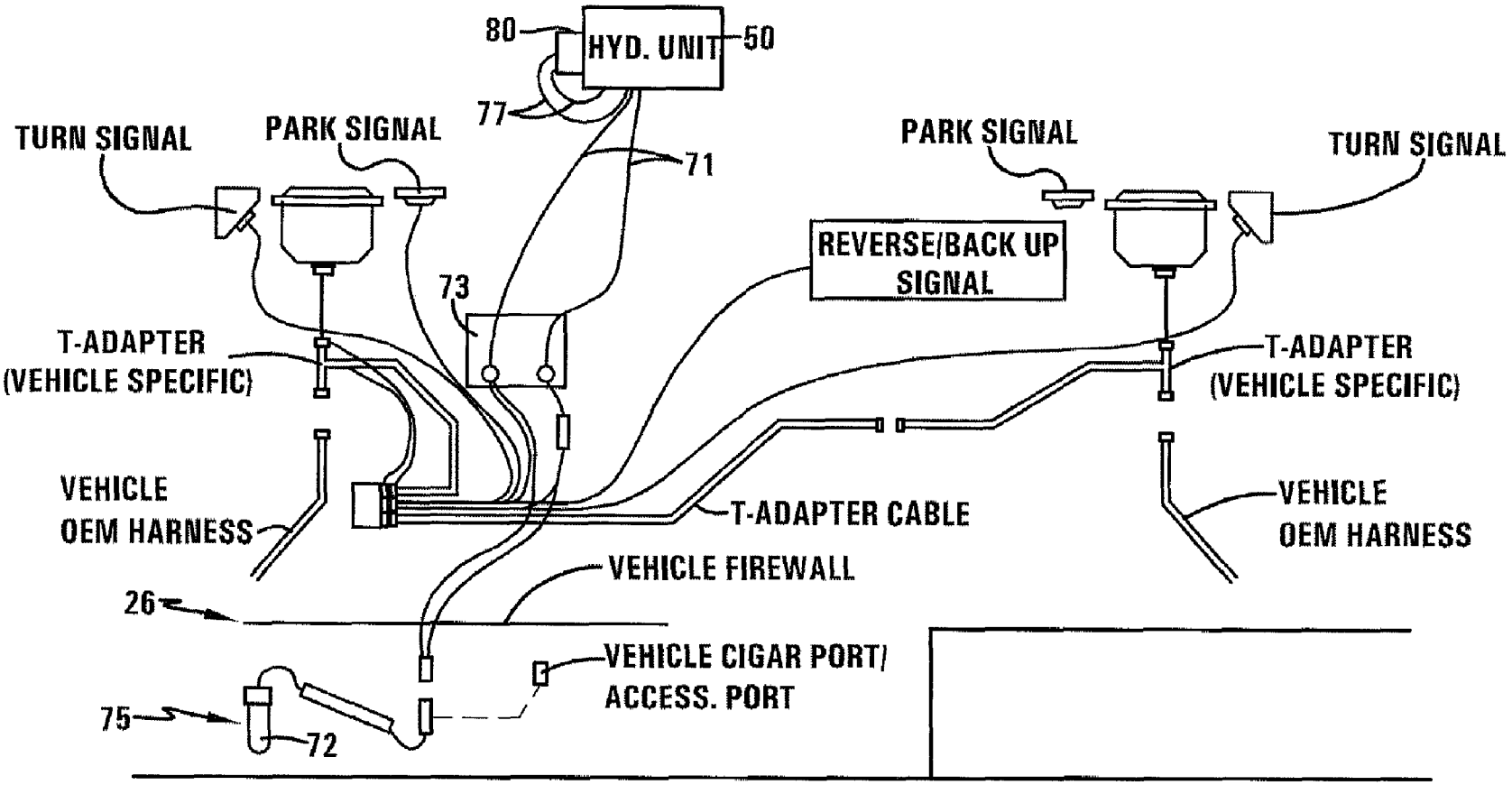
FIG. 12 is a wiring schematic showing how the hydraulic power mechanism may be attached to the vehicle and to the control system.

FIG. 12 shows how the control system 26 may be attached to the snowplow system 20. Power wiring 71 may be used to communicate power from the battery 73 to the hydraulic power mechanism 50 in a manner well known in the art. A controller 75 is used by the operator to control the hydraulic power mechanism 50 to move or attach the snowplow 22. While a hand held controller 72 is shown, it should be understood that this invention will work well with any conventional controller as well. Control wiring 77 may be used to communicate control functions to the particular hydraulic modules 80 that are mounted to the base unit 60. The control wiring 77 may originate from the controller 75, the hydraulic power mechanism 50 or from another source chosen with sound engineering judgment. In one embodiment, control wiring 77 may not be required at all as a wireless controller, perhaps using radio frequency signals, can be used.

With reference to FIGS. 1-17, it should be noted that there are at least two scenarios under which it may be desirable to use the same base unit 60 with various hydraulic modules 80 to meet different hydraulic needs. In a first scenario, it should be noted that this invention is ideal for snowplow system 20 distributors. Suppose, for example, that a customer orders a snowplow system 20, such as show in FIG. 1. In this case, the distributor will use the standard hydraulic power mechanism base unit 60 and then add the appropriate hydraulic module(s) 80 to provide the appropriate hydraulic functions for that snowplow 22. If, on the other hand, a customer wants a different snowplow system 21 that may include a different snowplow 23, such as shown in FIGS. 2 and 12, the distributor begins with the same base unit 60 but adds a different number of hydraulic modules 80 to provide the appropriate hydraulic functions for the snowplow system 21. In this way, the distributor can keep a much reduced inventory and will have greater flexibility to provide a wide variety of hydraulic power mechanisms 50 in accordance with the needs of the customers.

With continuing reference to FIGS. 1-17, in a second scenario, it may be desirable to adjust a hydraulic power mechanism 50 already formed and mounted to a snowplow system 20. In a first embodiment, it may be desirable to adjust the hydraulic power mechanism 50 while using the same set of hydraulic components 28 and the same snowplow 22. For example, it may be desirable to adjust the hydraulic power mechanism 50 to provide greater hydraulic pressure. As another example, it may be desirable to adjust the hydraulic power mechanism 50 to accommodate a new or improved control system 26. With this embodiment it is only necessary to add or adjust the hydraulic modules 80 according to the hydraulic need. For example, in one case it may be only necessary to add or replace valves 66 to the existing hydraulic module 80. In this case, the hydraulic power mechanism 50 provides a second hydraulic function, for example increased hydraulic pressure, due to the new valves 66. In another case, it may be desirable to remove the first hydraulic module 80 and replace it with the second hydraulic module 180. Depending on the nature of the second hydraulic module 180, it may also be necessary to modify the control system 26 to accommodate it. Thus, for example, it may be necessary to add additional control wiring 77 from the newly added hydraulic valves 66 to the control system 26. It may also be necessary to activate the control system 26 to enable the second hydraulic module 80 to properly operate. Such control system 26 modifications will depend on the particular hydraulic module 80 that has been installed.

Still referring to FIGS. 1-17 and the second scenario, in a second embodiment it may be desirable to adjust the hydraulic power mechanism 50 due to the installation of a new set of hydraulic components 28 but still using the same initial snowplow 22. An existing snowplow 22, for example, may only include the hydraulic components to raise and lower the snowplow 22. If it were desirable to add a snowplow pivot feature, additional hydraulic components would be required but the same snowplow 22 may be used. In this case, the hydraulic power mechanism 50 can be modified as described above (by mounting a second hydraulic module 180 to the base unit 60) when the new hydraulic components (such as a lift cylinder 32) are added. In a third embodiment, a new snowplow, such as the V-plow 23 shown in FIGS. 2 and 12, may be installed in place of a standard or straight plow as shown in FIG. 1. In this case, the required addition of appropriate hydraulic components would be required as well as the appropriate change to the hydraulic power mechanism 50. Once again, however, it is relatively easy to adjust the hydraulic power mechanism 50 because all that is necessary is to mount a second hydraulic module 180 that either alone or in combination with the first hydraulic module 80 will accommodate the new snowplow 23. Of course corresponding adjustments to the control system 26 may also be required.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

We claim:

1. A snowplow system comprising:

a snowplow frame;

a snowplow mountable to the snowplow frame;

a modular hydraulic power mechanism mountable to the snowplow frame and comprising:

(a) a base unit comprising:

(1) a base plate positioned substantially horizontally;

(2) a hydraulic reservoir connected to the base plate and positioned below the base plate; and, (3) a hydraulic pump unit connected to the base plate and positioned substantially above the base plate;

(b) a first hydraulic module mounted on top of the base plate and positioned above the base plate, the first hydraulic module comprising at least a first hydraulic control valve, the first hydraulic module operating with a first hydraulic cylinder to provide a first hydraulic function to the snowplow;

(c) wherein the base unit is adapted to receive in place of the first hydraulic module a second hydraulic module mounted on top of the base plate and positioned above the base plate, the second hydraulic module comprising at least a second hydraulic control valve, the second hydraulic module operating with a second hydraulic cylinder to provide a second hydraulic function to the snowplow; and, (d) wherein the first hydraulic function is substantially different than the second hydraulic function;

a set of hydraulic components operatively connected to the hydraulic power mechanism and to the snowplow, the set of hydraulic components comprising at least the first hydraulic cylinder, wherein the set of hydraulic components comprise no part of the hydraulic power mechanism; and, a control system operatively connected to the hydraulic power mechanism to adjust the snowplow.

2. The snowplow system of claim 1 wherein the first hydraulic function consists of raising and lowering the snowplow using the first hydraulic cylinder and the second hydraulic function consists of raising and lowering the snowplow using the first hydraulic cylinder as well as pivoting the snowplow from side to side using the second hydraulic cylinder.

3. The snowplow system of claim 1 wherein the first hydraulic function consists of raising and lowering the snowplow using the first hydraulic cylinder and the second hydraulic function consists of raising and lowering the snowplow using the first hydraulic cylinder as well as pivoting a left wing and a right wing defining the snowplow, wherein the left wing pivots using the second hydraulic cylinder and the right wing pivots using a third hydraulic cylinder, and wherein the wings pivot independently of each other.

4. The snowplow system of claim 1 wherein the first hydraulic function consists of raising and lowering the snowplow using the first hydraulic cylinder and the second hydraulic function consists of attaching the snowplow to a vehicle using the second hydraulic cylinder.

5. The snowplow system of claim 1 wherein the set of hydraulic components further comprises at least the second hydraulic cylinder.

6. A method comprising the steps of:

providing a snowplow system comprising a snowplow frame and a first snowplow mountable to the snowplow frame;

providing a modular hydraulic power mechanism mountable to the snowplow frame and comprising: (a) a base unit comprising: (1) a base plate positioned substantially horizontally; (2) a hydraulic reservoir connected to the base plate and positioned below the base plate; and, (3) a hydraulic pump unit connected to the base plate and positioned substantially above the base plate; and, (b) a first hydraulic module mounted on top of the base plate and positioned above the base plate, the first hydraulic module comprising at least a first hydraulic control valve, the first hydraulic module operating with a first hydraulic cylinder to provide a first hydraulic function to the first snowplow;

providing a set of hydraulic components operatively connected to the hydraulic power mechanism and to the first snowplow, the set of hydraulic components comprising at least the first hydraulic cylinder, wherein the set of hydraulic components comprise no part of the hydraulic power mechanism;

providing a control system operatively connected to the hydraulic power mechanism to control the first hydraulic function;

replacing the first snowplow with a second snowplow mountable to the snowplow frame;

adding a second hydraulic cylinder to the set of hydraulic components;

replacing the first hydraulic module with a second hydraulic module mounted on top of the base plate and positioned above the base plate, the second hydraulic module comprising at least a second hydraulic control valve, the second hydraulic module operating with the second hydraulic cylinder to provide a second hydraulic function to the second snowplow, wherein the first hydraulic function is substantially different than the second hydraulic function;

modifying the control system to control the second hydraulic function.

7. The method of claim 6 wherein the first hydraulic function consists of raising and lowering the first snowplow using the first hydraulic cylinder and the second hydraulic function consists of raising and lowering the second snowplow using the first hydraulic cylinder as well as pivoting the second snowplow from side to side using the second hydraulic cylinder.

8. The method of claim 6 wherein the first hydraulic function consists of raising and lowering the first snowplow using the first hydraulic cylinder and the second hydraulic function consists of raising and lowering the second snowplow using the first hydraulic cylinder as well as pivoting a left wing and a right wing defining the second snowplow, wherein the left wing pivots using a second hydraulic cylinder and the right wing pivots using a third hydraulic cylinder and the wings pivot independently of each other.

9. The method of claim 6 wherein the first hydraulic function consists of raising and lowering the first snowplow using the first hydraulic cylinder and the second hydraulic function consists of attaching the second snowplow to a vehicle using the second hydraulic cylinder.

* * * * *